US005761936A

United States Patent [19]

Katayama

[11] Patent Number: 5,761,936

[45] **Date of Patent: *Jun. 9, 1998**

[54] CYLINDRICAL LEVER-TYPE DOOR LOCK

[75] Inventor: Akira Katayama, Tokyo-to, Japan

[73] Assignee: MIWA Lock Co., Ltd., Tokyo, Japan

[ * ] Notice: The term of this patent shall not extend beyond the expiration date of Pat. No. 5,605,064.

[21] Appl. No.: 704,197

[22] Filed: Aug. 28, 1996

Related U.S. Application Data

[63] Continuation of Ser. No. 272,176, Jul. 8, 1994, abandoned.

[30] Foreign Application Priority Data

Apr. 20, 1994 [JP] Japan ..... 6-106129

[51] Int. Cl.[6] ..... E05B 13/10

[52] U.S. Cl. ..... 70/224; 70/215; 70/370; 292/336.3; 292/358

[58] Field of Search ..... 292/169.22, 169.23, 292/DIG. 61, 336.3, 347, 358; 70/224, 358, 370, 195, 201, 215, 216, DIG. 39

[56] References Cited

U.S. PATENT DOCUMENTS

| | | | |
|---|---|---|---|
| 1,892,709 | 1/1933 | Shaw | 70/224 |
| 2,023,941 | 12/1935 | Voight | 70/224 |
| 2,062,487 | 12/1936 | Voight | 70/224 |
| 2,803,957 | 8/1957 | George | 292/169.23 X |
| 3,228,218 | 1/1966 | Wilson | 292/169.23 X |
| 3,633,393 | 1/1972 | Hisatsune | 70/276 |
| 3,718,015 | 2/1973 | Tornoe et al. | 70/224 |
| 3,955,387 | 5/1976 | Best et al. | 70/370 X |
| 4,037,865 | 7/1977 | Hook | 292/357 |
| 4,073,172 | 2/1978 | Schlage | 70/370 X |
| 4,604,879 | 8/1986 | Neary et al. | 70/224 |
| 4,884,834 | 12/1989 | Ozagir et al. | 292/DIG. 38 X |
| 4,921,289 | 5/1990 | Shen | 70/107 X |
| 5,077,994 | 1/1992 | Trull et al. | 70/224 |
| 5,141,269 | 8/1992 | Haq et al. | 292/169 |
| 5,265,924 | 11/1993 | Kim | 292/357 X |
| 5,316,355 | 5/1994 | Hartwell et al. | 292/DIG. 38 X |
| 5,317,889 | 6/1994 | Solovieff et al. | 70/224 |
| 5,398,531 | 3/1995 | Shen | 70/224 |
| 5,433,495 | 7/1995 | Uffner | 292/356 X |
| 5,481,890 | 1/1996 | Millman | 70/224 |
| 5,605,064 | 2/1997 | Katayama et al. | 70/224 |

FOREIGN PATENT DOCUMENTS

| | | | |
|---|---|---|---|
| 1126766 | 3/1962 | Germany | 292/169.22 |
| 629641 | 9/1949 | United Kingdom | 292/169 |

*Primary Examiner*—Lloyd A. Gall

*Attorney, Agent, or Firm*—Edwin E. Greigg; Ronald E. Greigg

[57] ABSTRACT

This invention is directed to a door lock including a housing with a lock body which cannot be easily rotated when a burglar attempts to forcedly further rotate the outside lever handle in excess of a limit for withdrawl movement of a latching slide body. A pluality of ingagement portions which react counter to a rotary motion are formed in the housing of the lock body, and a plurality of fixed engagement rods engage with the engagement portions are assembled relative to an inside fixed plate extended into an inner side wall surface of the door.

7 Claims, 8 Drawing Sheets

CYLINDRICAL LEVER-TYPE DOOR LOCK

This application is a continuation of application Ser. No. 08/272,176 filed Jul. 8, 1994, now abandoned.

BACKGROUND OF THE INVENTION

This invention relates to a door lock, and more particularly to a door lock having a lever handle which can be easily operated by a person having a disability in their hand.

An example of conventional door locks of this kind is described in the U.S. Pat. No. 5, 141,269 or the Japanese Patent Application Laid Open No. 297681/1992 (Tokkaisho No. 4-297681).

The fundamental configuration of this example will now be described with reference to the prior art illustrated by FIGS. 8 and 9.

Reference numeral 1 denotes a door pivotally supported by the door frame so that it can be opened and closed. A door lock 2 having an inside lever handle 3 positioned on the inside of the door and an outside lever handle 4 positioned on the outside of the door is illustrated.

Moreover, reference numeral 5 denotes a lock body of the door lock 2. An actual structure of the lock body 5 is described in the above-mentioned publication and the U.S. Pat. No. 4,604,879. Namely, the lock body 5 comprises a housing 7 which is opened at one side wall and having an annular wall 6 on the other side wall, a fixed support frame (not shown) within the housing, a slide body 29 for a latch which is advanced or withdrawn within the support frame, an attachment block for a fixed plate having female screws, a bearing member, a rotary shaft, and the like.

Reference numeral 8 denotes a latch having a latch bolt 9 held by the latching slide body 29 of the lock body 5. This latch 8 is arranged along a latch shaft axis 11 perpendicular to a handle shaft axis 10 of lever handles 3, 4 as shown in FIG. 8. A front plate 12 opposite a strike plate, not shown, is provided at latch 8 for connection to a door frame (not shown).

Reference numeral 13 denotes a fixed cylindrical bearing member on housing 7 of the lock body 5. This bearing member 13 has a male screw thread 14 at the outer circumferential surface, and is projected from annular wall 6 of the housing 7.

Reference numeral 15 denotes an outside plate fixed to the housing so that it is positioned at the opening side of the housing 7. This outside plate 15 has a plurality of projections 16 which stick into an outer wall 1*a* of door 1 at the internal surface thereof.

Reference numeral 17 denotes an inside plate fixed by a plurality of screws 18 on the housing so that it is positioned on the annular wall 6 side of housing 7. This inside plate 17 also has, at the inner surface thereof, a plurality of projections 19 which stick into the inner wall 1*b* of door 1. The inside fixed plate 17 is securely fixed on the housing 7 by small screws 18 respectively penetrated through a pair of penetration holes 20 formed at the inside fixed plate and a plurality of penetration holes 21 formed at annular wall 6 of housing 7. The outside and inside fixed plates 15, 17 are caused to be opposite to each other when they are respectively secured in place against wall surfaces 1*a*, 1*b* of door 1. It is to be noted that small bolts 18 that penetrate through penetration holes 21 of housing 7 are screw-connected to female holes of the attachment block within housing 7.

Reference 22 denotes a hexagon nut having a flange portion 23 in contact with the outer wall surface of inside fixed plate 17 and a tubular portion 25 which extends into a center hole 24 of inside fixed plate 17.

This hexagon nut 22 has a female screw thread 26, which is screw-connected to the male screw thread 14 of the previously described bearing member 13. This hexagon nut 22 serves to limit the inside fixed plate 17 so that it is located at a predetermined position, and to prevent small bolts 18 from becoming loosened.

Reference numerals 27, 28 denote inside and outside tubular rotary shafts disposed on the handle shaft axis 10. The end portions of these rotary shafts 27, 28 are respectively combined into the lock body 5 to advance or withdraw the latching slide body 29 through engagement pieces in a projection form formed at the inner end portion thereof. Further, inside and outside lever handles 3, 4 are respectively fitted over the outer end portions of the rotary shafts, each of which has a plurality of cut portions (elongated openings) 27*a*, 28*a*. In addition, the retracting operation of the previously described latch bolt 9 is carried out by rotation of the inside or outside rotary shaft 27 or 28.

Reference numerals 30, 31 denote inside and outside return spring cassettes disposed on the handle shaft axis 10, respectively. These return spring cassettes 30, 31 are formed separately from fixed plates respectively opposite thereto in this embodiment.

Moreover, these return spring cassettes 30, 31 have at the insides thereof spring members 32 for respectively returning lever handles 3, 4 to the initial positions. Further, these return spring cassettes 30, 31 have a pair of female screw portions 33 projected in a rod form from the inside walls, respectively. In addition, the inside return spring cassette 30 and the outside return spring cassette 31 are integrally connected through large bolts 34 screw-connected to the female screw portions 33 from the handle side.

Reference numerals 35, 36 denote inside and outside decorative caps disposed on the handle shaft axis, respectively.

It is to be noted that a turn button 38 is assembled into a penetration hole 37 of the inside lever handle 3. Further, a cylinder lock 40 is fitted into an opening 39 of the outside lever handle 4.

However, the door lock 2 thus constructed has the following drawbacks as recited below.

(1) In the case where the outside lever handle 4 is rotated in an unlatching (unlocking) direction, outside rotary shaft 28 is rotated. As a result, latching slide body 29 is withdrawn into housing 7 of lock body 5 by the cam mechanism. Accordingly, when a burglar attempts to further forcedly rotate the outside lever handle 4 in excess of the limit (limiting point) of withdrawal movement of latching slide body 29, small screws 18 are deformed. For this reason, housing 7 of lock body 5 is separated from the inside fixed plate 17 and is rotated by itself.

Accordingly, latch bolt 9 of latch 8 was offset from latching slide body 29 of lock body 5.

(2) Since the outside fixed plate 15 and the inside fixed plate 17 are respectively fixedly attached at housing 7 of lock body 5, adjustment of a dimension in a width direction between both fixed plates 15 and 17 cannot be made. Accordingly, it is impossible to attach door lock 2 in correspondence with the thickness of door 1.

(3) Return spring cassettes 30, 31 and fixed plates 15, 17 are respectively formed as separate bodies. For this reason it is necessary to fixedly attach plates 15, 17 to housing 7, therefore a person is unable to attach door lock 2 to door 1 with ease.

(4) Since return spring cassettes 30, 31 are directly provided on respective rotary shafts 27, 28, metal friction takes place between both members.

SUMMARY OF THE INVENTION

In view of drawbacks with the prior art as described above, an object of this invention is to provide a door lock which can sufficiently cope with measures to counter overly rotating the outside lever handle, which can be attached in correspondence with the thickness of the door, and which can be attached to the door with ease.

To achieve the above-described objects, in accordance with this invention, there is provided a door lock in which an inside lever handle 3A and an outside lever handle 4A are attached on a lock body 5A assembled into door 1A, and retracting operation of latch bolt 9 of latch 8 disposed on latch shaft 11 perpendicular to handle axis 10A is carried out by rotation of the inside or outside rotary shaft 27A br 28A of lock body 5A, characterized in that a plurality of engagement portions 51 for measures to counter torsion are formed at housing 7A of the lock body 5A, and that a plurality of fixed engagement rods 77 adapted to be engaged with the engagement portions 51 are provided at the inside fixed plate 17A projected into the inner wall surface 1*b* of door 1A.

DESCRIPTION OF THE PREFERRED EMBODIMENT

Figure 1:
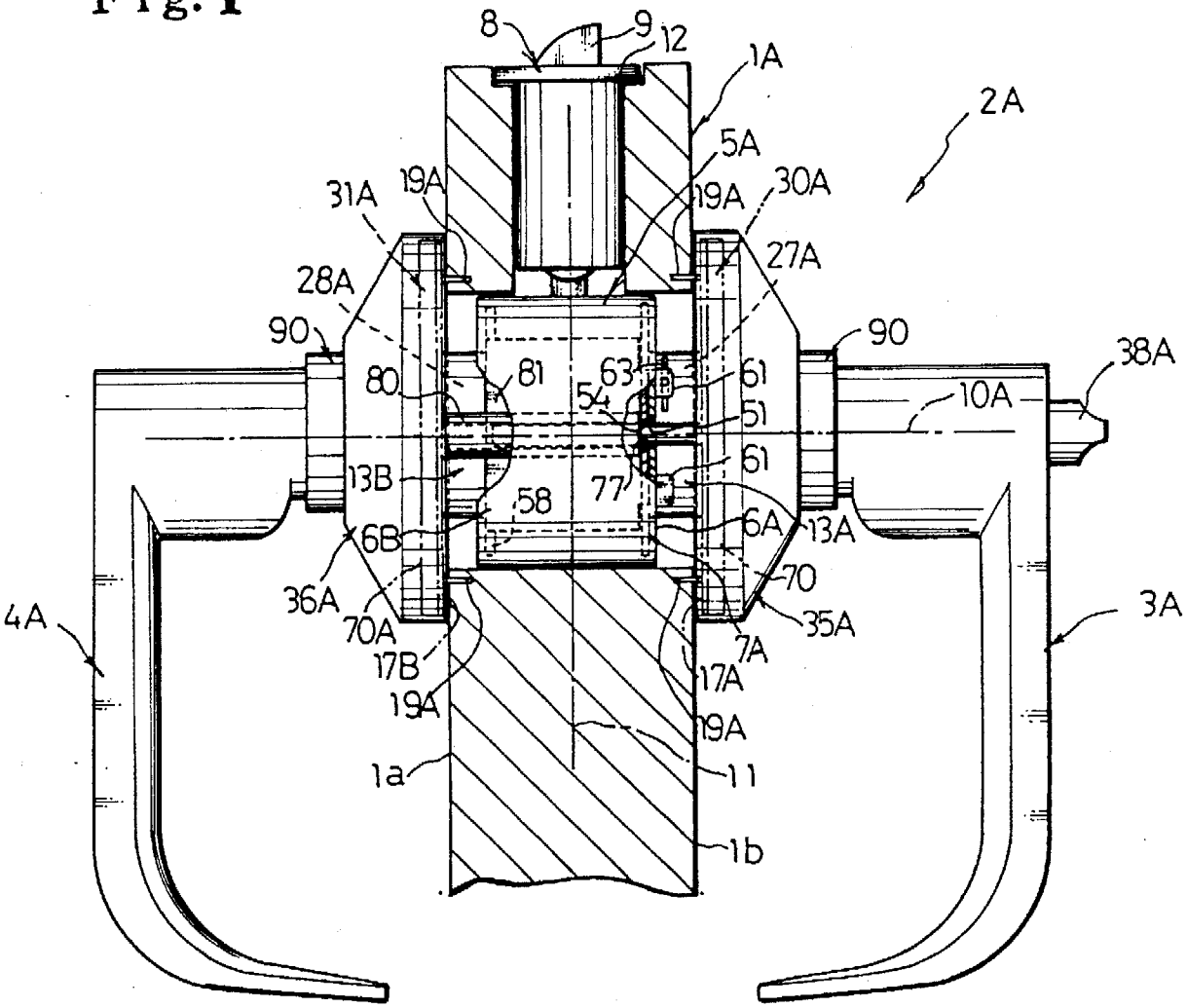
FIG. 1 is an explanatory view showing the attachment state of a door lock according to an embodiment of this invention.
Figure 2:
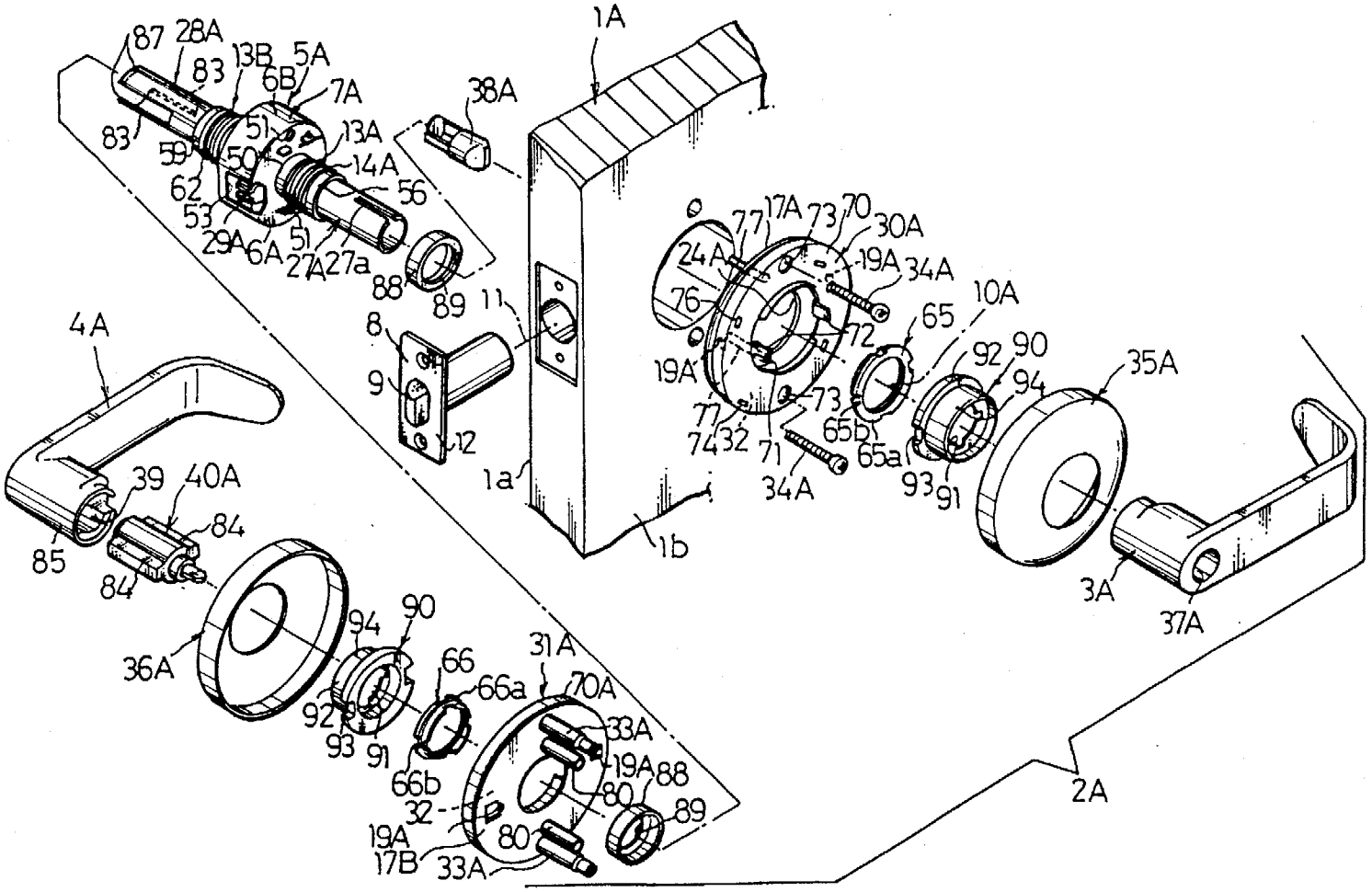
FIG. 2 is an exploded perspective view of the door lock shown in FIG. 1.

This invention will now be described in connection with the preferred embodiment shown. In the description of this embodiment, the same or similar reference numerals are respectively attached to the same portions of the conventional door lock, and the repetitive explanation will be omitted.

Figure 3:
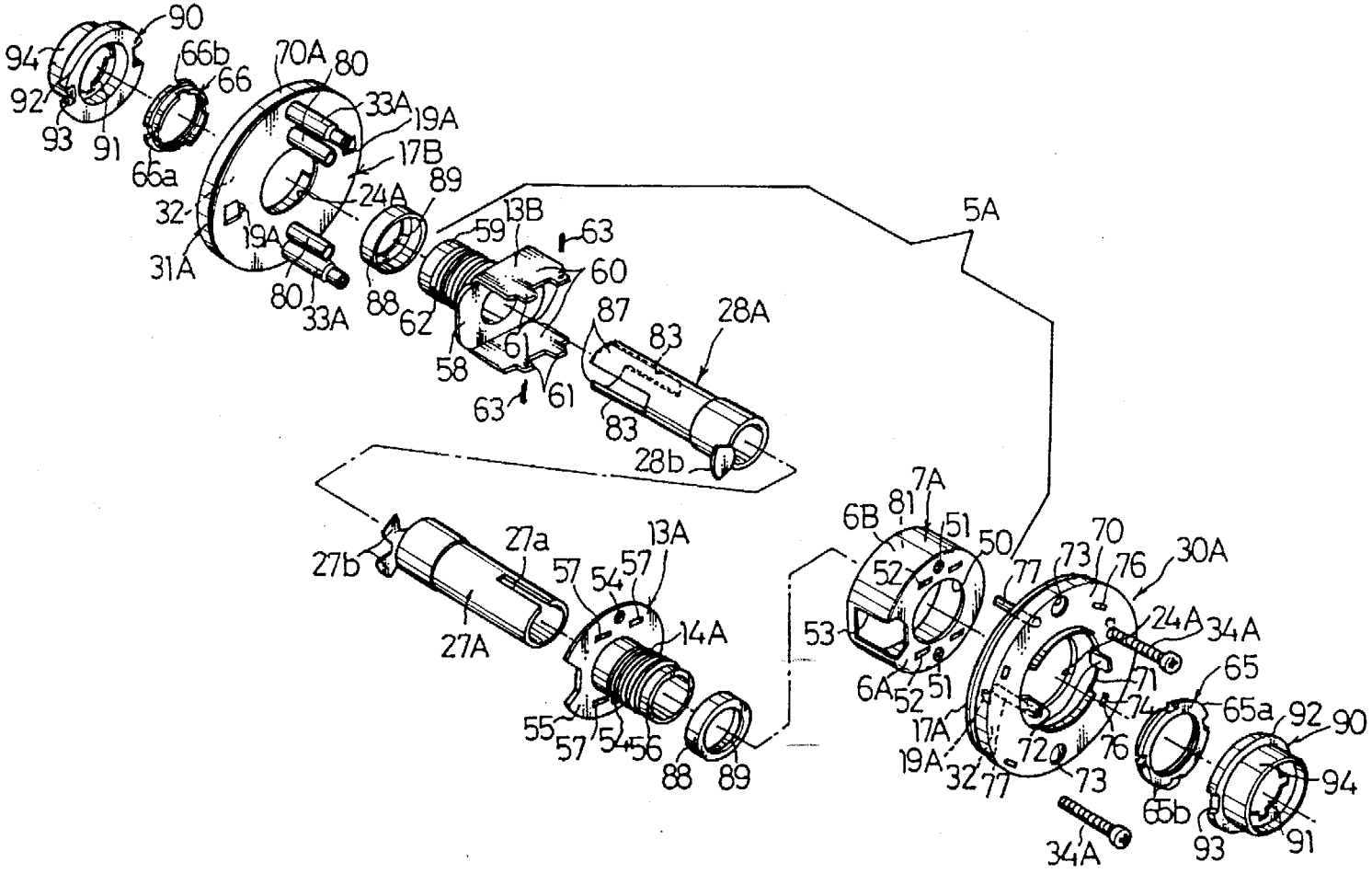
FIG. 3 is an exploded perspective view of the essential parts of this invention.
Figure 4:
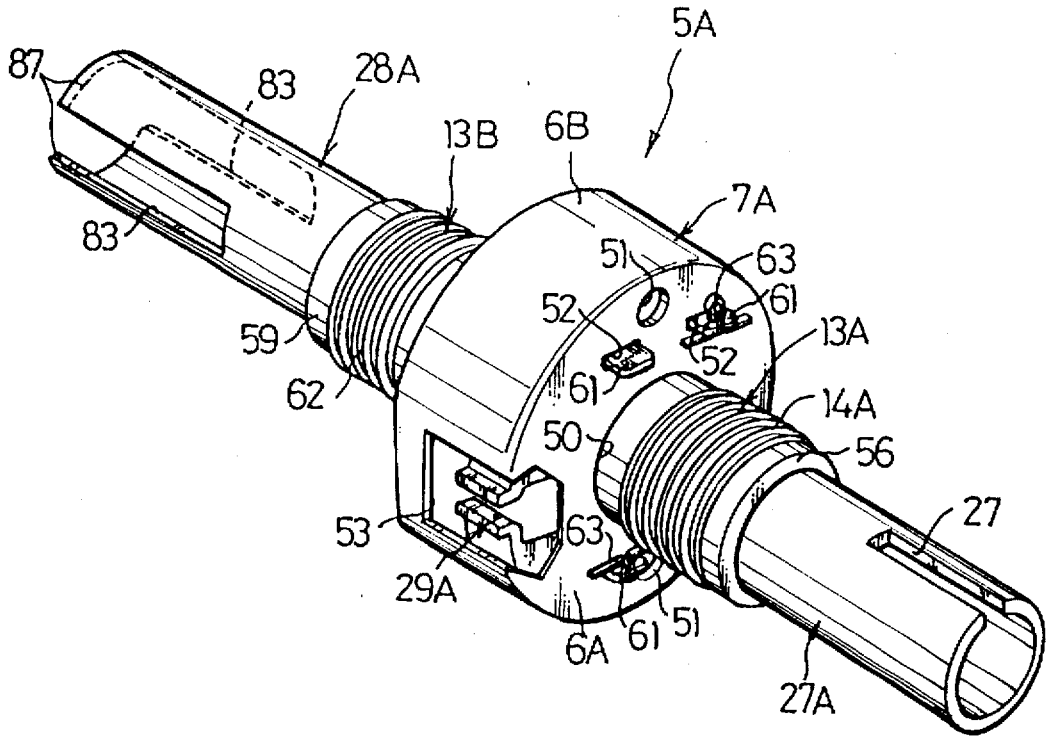
FIG. 4 is a perspective view of the essential parts of this invention.
Figure 5:
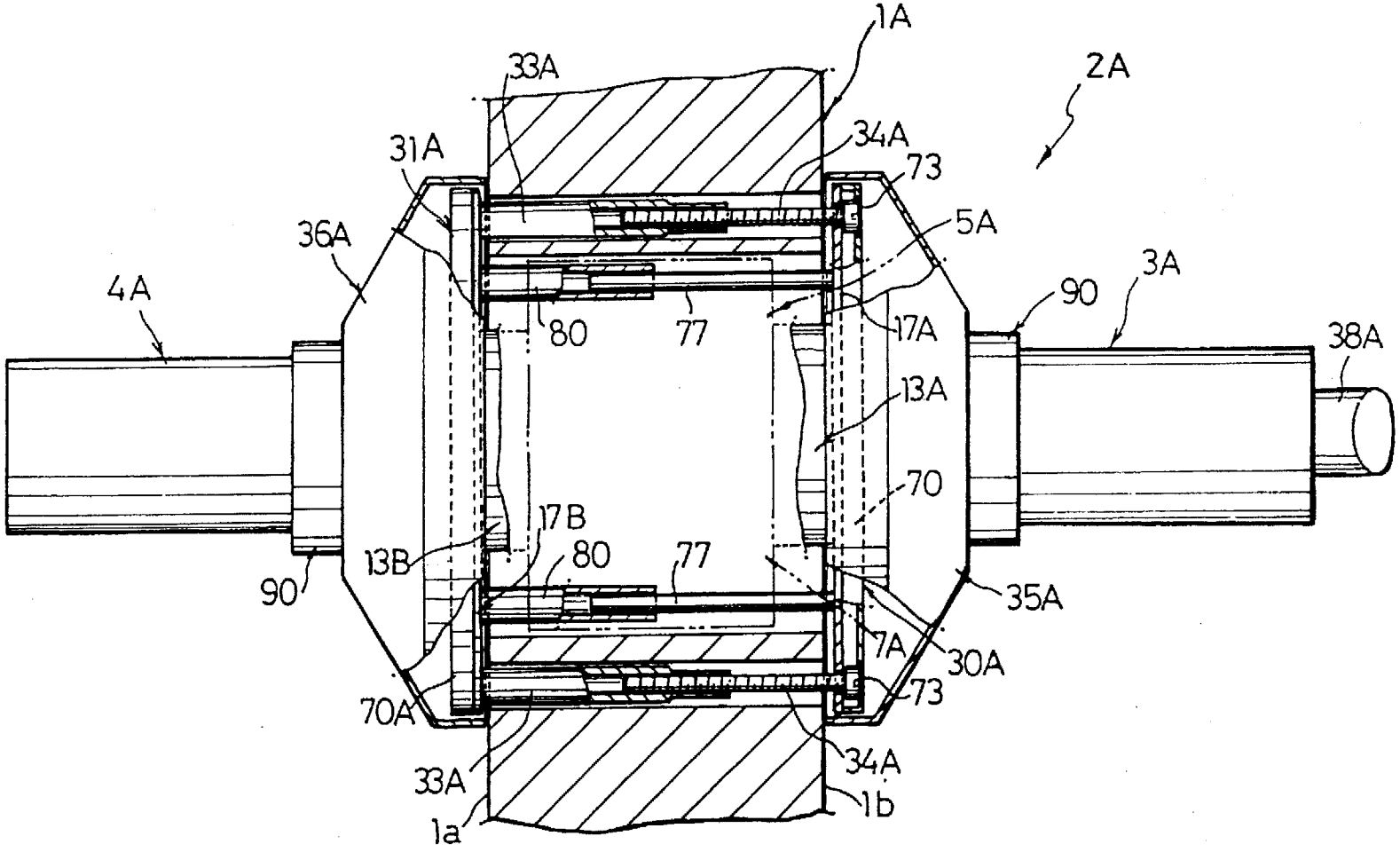
FIG. 5 is a partially schematically cross sectional explanatory view in the attachment state of the door lock of this invention.

In FIGS. 1 to 7, reference numeral 1A denotes a door and reference numeral 2A denotes a door lock. Further, reference numeral 3A denotes an inside lever handle, reference numeral 4A denotes an outside lever handle, reference numeral 5A denotes a lock body, and reference numeral 6A denotes an annular wall of housing 7A of the lock body. At the annular wall 6A, as shown in FIG. 4, a center hole 50 for an inside rotary shaft, a pair of penetration holes, engagement portions 51 for measures to counter torsion such as engagement cut portion, etc., and a plurality of attachment holes 52 for inside bearing members are respectively formed. Further, at circumferential wall 6B of housing 7A, a window portion 53 is formed through which engagement portions of a latching slide body 29A can be seen.

Reference numeral 13A denotes an inside bearing member fixedly attached to housing 7A of lock body 5A. This inside bearing member 13A is fitted into the housing 7A from the opening side thereof. The inside bearing member 13A is composed, as shown in FIG. 3, of a flange plate 55 in contact with the inner wall of annular wall 6A of housing 7A, and a cylindrical portion 56 which is integrally provided at the flange plate 55 and is projected from a center hole 50 of housing 7A. At the flange plate 55, a plurality of rectangular penetration holes 57 are formed in correspondence with attachment holes 52 of annular wall 6A and penetration holes 54 engaged with engagement rods of a fixed plate which will be described later. This penetration hole 54 may be a cut portion. In addition, a first adjustment screw thread 14A is formed at the outer circumferential wall of cylindrical portion 56.

Reference numeral 13B denotes an outside bearing member fixedly attached within housing 7A of lock body 5A. This outside bearing member 13B is also fitted into the housing 7A from the opening side thereof. The outside bearing member 13B is composed, as shown in FIG. 3, of a supporting wall 58 having a vertical portion positioned at the opening of housing 7A, and a cylindrical portion 59 which is provided integrally with the vertical portion of this supporting wall 58 and is projected toward the outside of housing 7A. At the front end portions of upper and lower horizontal supporting portions 60 opposite to each other of the supporting wall 58, there are provided, in this embodiment, four axially aligned engagement projections 61 which respectively penetrate penetration holes 57 of the previously described inside bearing member 13A and attachment holes 52 of housing 7A. Further, a second adjustment screw thread 62 is formed at the outer circumferential wall of cylindrical portion 59. The outside bearing member 13B is fixed at a predetermined position by pins 63 which are engaged with engagement projections 61 penetrated through housing 7A for preventing slipping off.

Reference numeral 65 denotes a first adjustment ring screw-connected to first adjustment screw 14A of the inside bearing member 13A. On the other hand, reference numeral 66 denotes a second adjustment ring screw-connected to a second adjustment screw 62 of the outside bearing member 13B. The first and second adjustment rings 65, 66 are used in the case where door lock 2A is attached in correspondence with the thickness of door 1A. Accordingly, first and second adjustment rings 65, 66 respectively have flanges 65*a*, 66*a* adapted to be in contact with fixed plates of return spring cassettes which will be described below. At the flanges 65*a*, 66*a*, a plurality of engagement grooves 65*b*, 66*b* are formed for rotating the first and/or second adjustment rings 65, 66 by using a driver (not shown).

Reference numerals 30A, 31A respectively denote inside and outside return spring cassettes arranged on the handle shaft axis 10A. These return spring cassettes 30A, 31A are formed integrally with fixed plates respectively opposite to housing 7A in this embodiment.

The inside return spring cassette 30A will be first described. Reference numeral 70 denotes an annular outside case having a fitting hole 71 formed so that its diameter is greater than the diameter of center hole 50 of housing 7A of lock body 5A. At the inner edge of the outside case 70, a pair of stopper pieces 72 extending in a direction of the handle shaft axis 10A are provided. Further, penetration holes in a form of circular hole 73 for large bolts 34A are formed at suitable portions of outside case 70. Furthermore, a plurality of square attachment holes 74 are formed at the outside case 70 at predetermined intervals. Reference numeral 17A denotes an annular inside fixed plate fixed on outside case 70 through a plurality of engagement pieces 76 engaged with the attachment holes 74. This inside fixed plate 17A has a plurality of projections 19A adapted to be projected into inner wall **1*b* of door 1A at the internal surface as in the prior art. At the inside fixed plate 17A, there are provided, in this embodiment, a pair of insertion rods 77 as engagement rods adapted to be inserted into penetration holes 51 of housing 7A of lock body 5A in order to counter torsion. While it is sufficient that a single engagement rod 77 is provided, it is desirable that a plurality of engagement rods 77 are provided. It is to be noted that center hole 24A of inside fixed plate 17A is smaller than fitting hole 71 of outside case 70**.

The outside return spring cassette 31A will now be described. This outside return spring cassette 31A is of a structure similar to that of the inside return spring cassette 30A. Accordingly, the same reference numerals are respectively attached to the same portions and the repetitive explanation is omitted. In this example, reference numeral 17B denotes an outside fixed plate, and reference numeral 70A denotes an outside case.

Accordingly, portions different from those of inside return spring cassette 30A will now be described. Reference numeral 80 denotes a pair of fitting tubes provided in a projected manner of outside fixed plate 17B. As shown in FIG. 1, this fitting tube 80 is inserted into a space 81 between the inner wall of housing 7A and the outer wall of supporting wall 58 of the outside bearing member 13B, and is fitted over insertion rod 77 extending from an inside of return spring cassette 30A and inserted into penetration hole 51 to counter torsion of housing 7A. Reference numeral 33A denotes a pair of female portions provided in a projected manner at the outside fixed plate 17B. These female screw portions 33A are positioned outwardly of fitting tube 80 and are provided in parallel to the fitting tubes 80. In this embodiment, female screw portions 33A are slightly longer than the fitting tubes 80. The return spring cassettes 30A, 31A can become closer to the side of housing 7A or become away therefrom by adjusting positions of first and/or second adjustment rings 65, 66. Further, the return spring cassettes 30A, 31A are integrally fixed by large bolts 34A penetrated through penetration holes 73 of inside return spring cassette 30A, and screw-connected to female screw threaded portions 33A of the outside return spring cassette 31A.

Reference numerals 27A, 28A denote inside and outside tubular rotary shafts disposed on the handle shaft axis 10A. The end portions of these rotary shafts 27A, 28A are respectively assembled into the lock body 5A. At respective inner end portions of rotary shafts 27A, 28A, engagement cam pieces **27*b*, 28*b* in a form of projection which are engaged with the side wall of latching slide body 29A** are formed.

Figure 6:
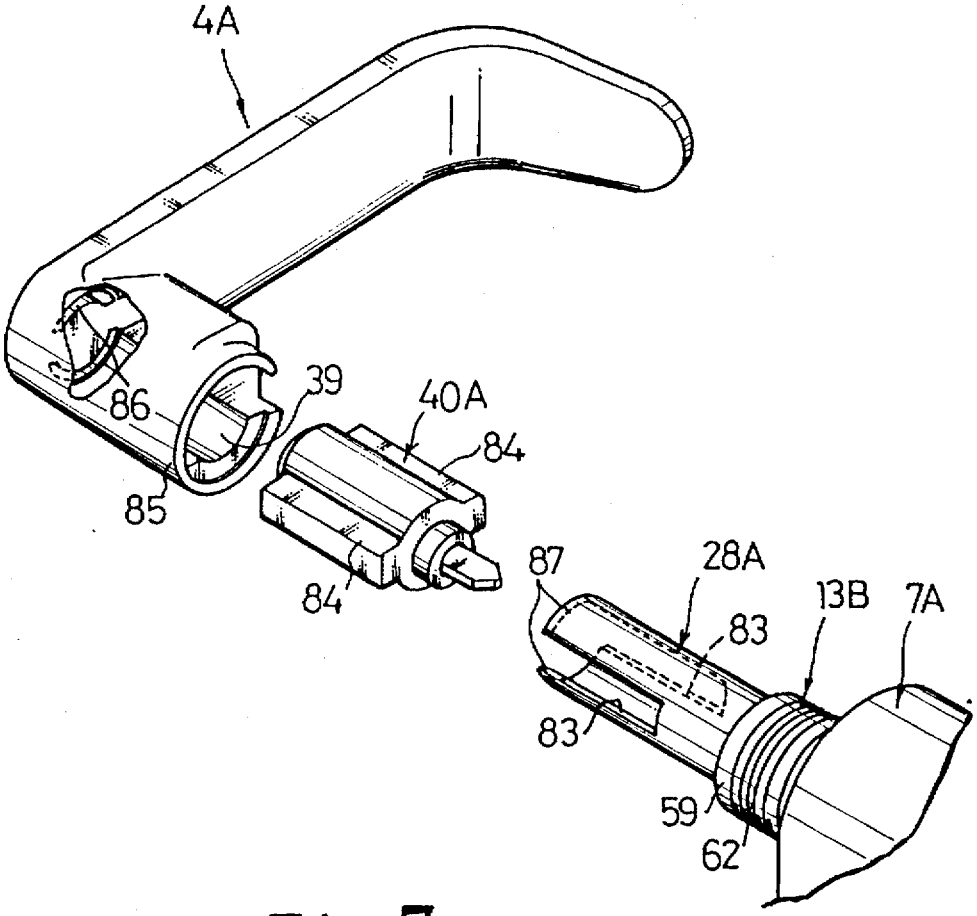
FIG. 6 is an explanatory view showing the relationship of an outside lever handle, cylinder lock and outside rotary shaft of this invention.
Figure 7:
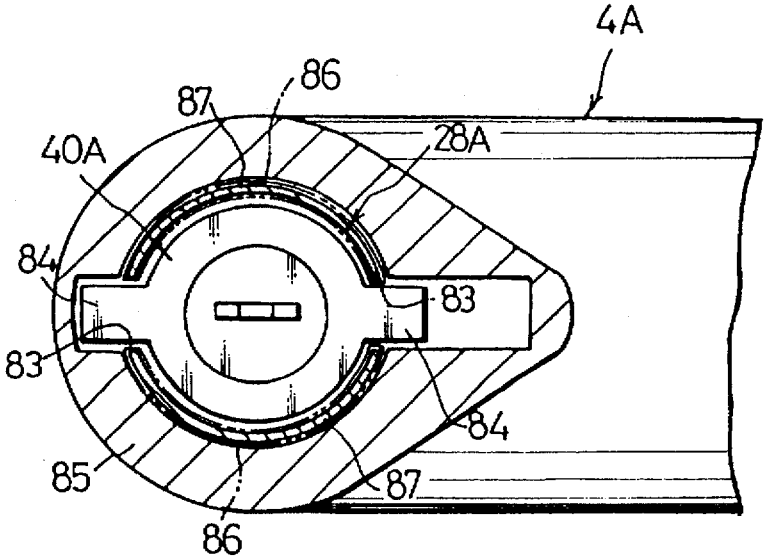
FIG. 7 is a schematically explanatory view showing the state where respective members in FIG. 6 are combined.
Figure 8:
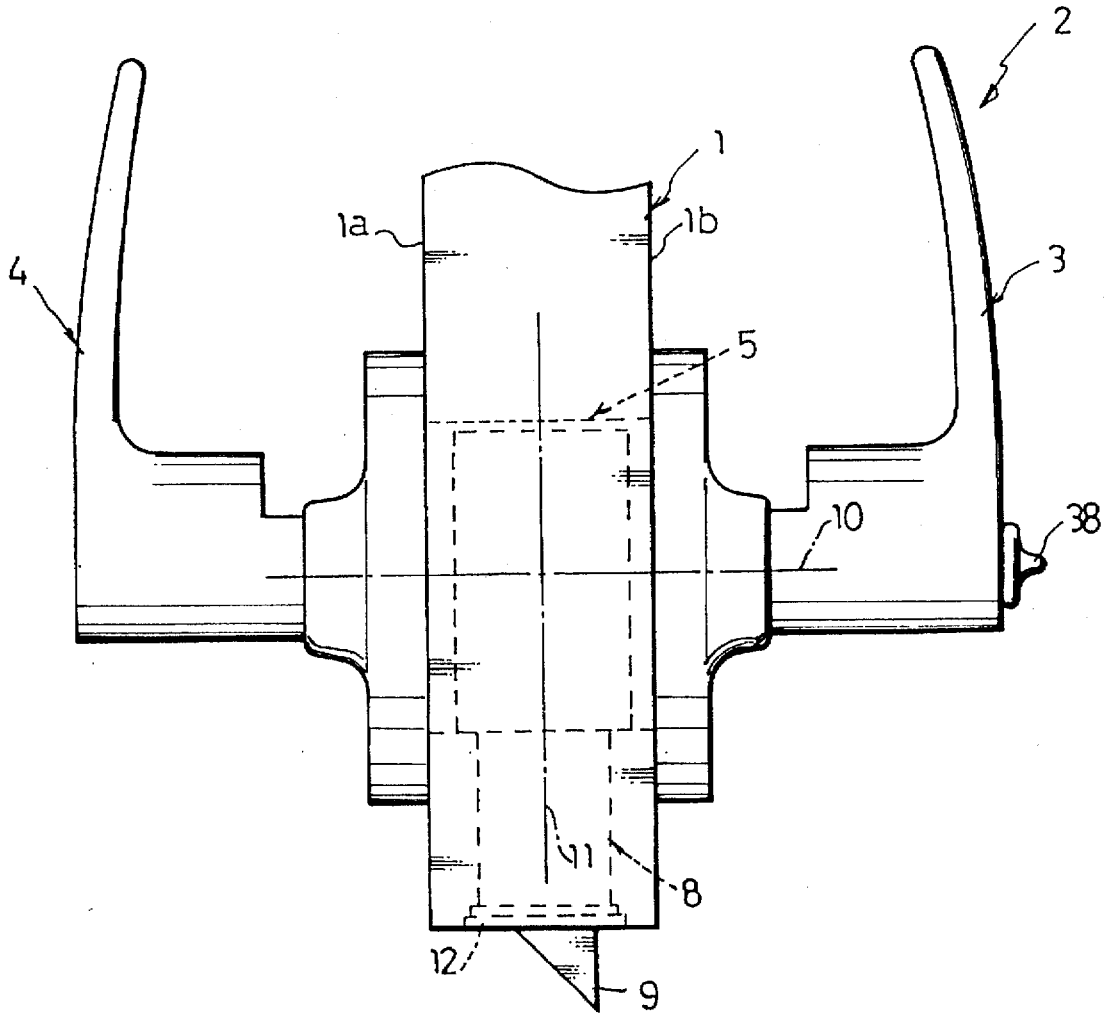
Fig. 8 PRIOR ART
FIG. 8 is an explanatory view showing the attachment state of an example of a conventional door lock.
Figure 9:
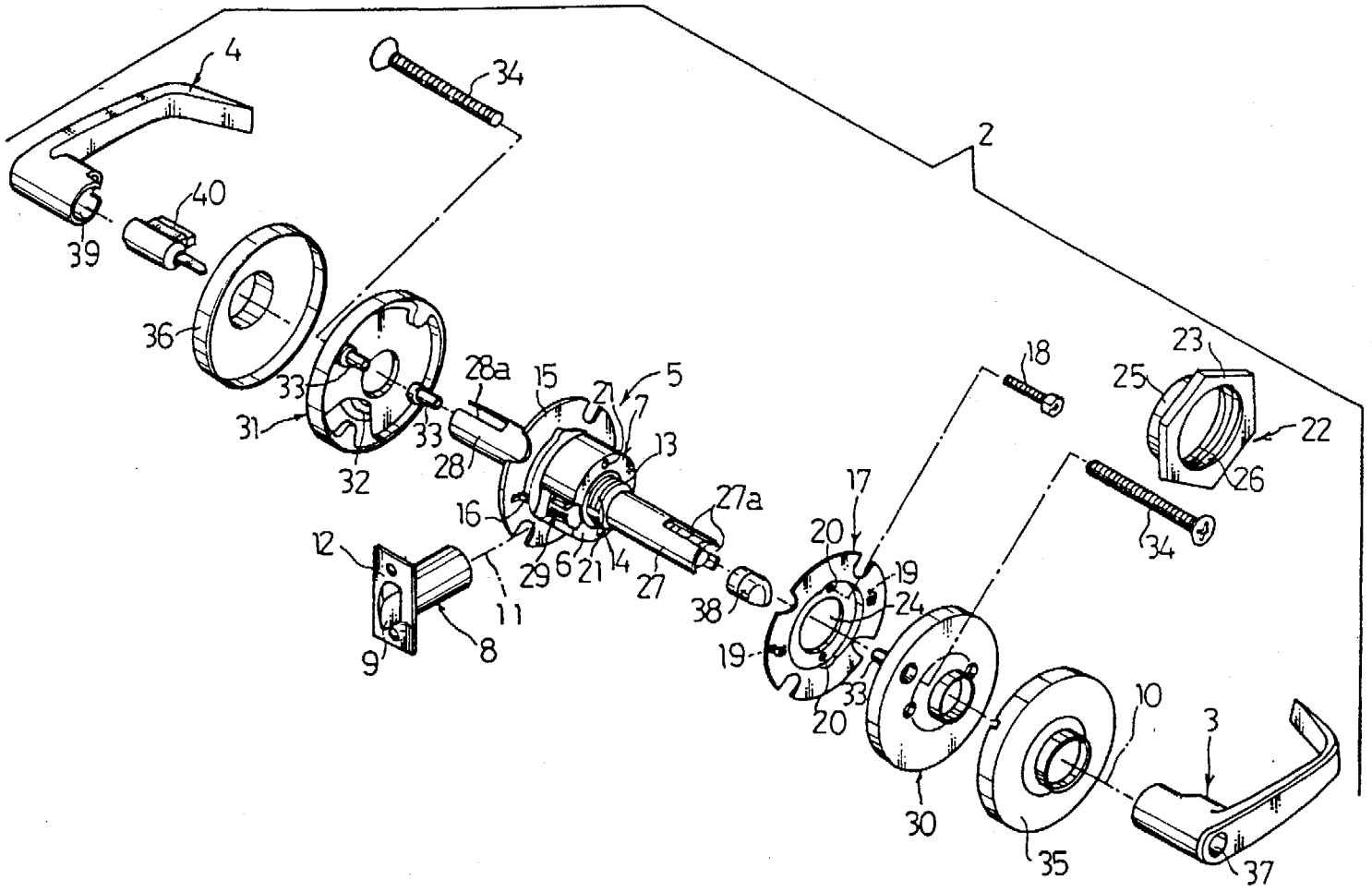
Fig. 9 PRIOR ART
FIG. 9 is an exploded perspective view of the door lock shown in FIG. 8.

Meanwhile, at the external end portion of this outside rotary shaft 28A, as shown in FIG. 6, oppositely disposed slots 83 are cut in the outside rotary shaft 28A from an outer end toward the cam pieces **28*b*. The oppositely disposed slots are engaged by a pair of oppositely disposed ribs 84 of a cylinder lock 40A which includes a magnet pin tumbler therein. The ribs 84 and one end of the cylinder lock 40A slide into the slots 83 of the outside rotary shaft 28A and the opposite end of the cylinder lock and the outside rotary shaft slide into the handle shaft 4A as shown in FIG. 7. The outside rotary shaft 28A includes end portions 87 formed by the slots 83 which engage with engagement recesses 86 formed at suitable portions of the inner wall of a tubular fitting portion 85 of the outside lever handle 4A, shown in FIG. 6**.

Reference numeral 88 denotes a metal abrasion prevention member which is formed of a synthetic resin in a ring form having an engagement hole 89 fitted one each to respective rotary shafts 27A, 28A and fitted over respective end portions of metallic cylindrical portions 56, 59 of inside bearing member 13A and outside bearing member 13B respectively.

Reference numeral 90 denotes two tubular metallic decorative members having engagement holes 91 fitted to rotary shafts 27A, 28A, respectively. These members 90 are assembled so that they are loosely fitted into engagement holes 71 of return spring casettes 30A, 31A. These members 90 respectively have, at ring shaped portions 92, grooves 93 which can be engaged with stopper pieces 72 of return spring cassettes 30A, 31A. The tubular decorative members have an inner diameter which receives the synthetic resin element 88. The synthetic resin element prevents metallic abrasion between members 56 and 90. In addition, these members 90 respectively have tubular portions 94 into which the end portions of tubular fitting portions 85 of lever handles 3A, 4A are fitted and secured in place.

Reference numerals 35A, 36A denote inside and outside decorative caps disposed on the handle shaft axis 10A. It is to be noted that turn button 38A is assembled into penetration hole 37A of inside lever handle 3A.

The operation of the door lock thus constructed will now be described.

In the case where outside lever handle 4A is rotated in unlatching (unlocking) direction, outside rotary shaft 28A is rotated. Thus, latching slide body 29A is withdrawn into housing 7A of lock body 5A by the cam mechanism.

When a burgular attempts to further forcedly rotate outside lever handle 4A in excess of its rotational limit (limiting point) for the withdrawal movement of latching slide body 29A, a rotational force is applied to engagement rods 77 of the inside fixed plate 17A of inside return spring cassette 30A through housing 7A. At this time, in the case of the embodiment where a plurality of fitting tubes 80, which are fitted over the engagement rods 77, are fixedly provided at outside fixed plate 17B of outside return spring cassette 31A, a force is applied to both fitting tubes 80 and engagement rods 77 through housing 7A to counter torsion.

Accordingly, since the fitting tubes and the engagement rods are not easily deformed in cooperation with each other, housing 7A of lock body 5A is not rotated. As a result, latch bolt 9 is not removed from latching slide body 29A of lock body 5A.

In the case where door lock 2A is attached in correspondence with the width of door 1A, positions of first and/or second adjustment rings 65, 66 are adjusted. By this adjustment, it is possible to allow return spring cassettes 30A, 31A to become closer to the side of housing 7A or become further away from housing 7A.

As apparent from the foregoing description, this invention provides effects/advantages recited below.

(1) When a burglar attempts to further forcedly rotate outside lever handle 4A in excess of a limit (limiting point) of withdrawal movement of latching slide body 29A, housing 7A of lock body 5A is not easily rotated. Accordingly, latch bolt 9 of latch 8 does not slip off from latching slide body 29A of lock body 5A.

(2) In the case of the embodiment where the outside fixed plate 17B extends into the outer wall surface 1a of door 1A at lock body 5A, and a plurality of fitting tubes 80 that counter torsion which are fitted over engagement rods 77 of inside fixed plate 17A are fixedly provided on the outside fixed plate 17B, the advantage of the above-mentioned item (1) can be further exhibited.

(3) In the case of the embodiment where fixed plates 17A, 17B respectively constitute portions of return spring cassettes 30A, 31A, it is possible to attach the door lock to the door with ease.

(4) By adjusting positions of first and/or second adjustment rings 65, 66, it is possible to allow return spring cassettes 30A, 31A to become close to the side of housing 7A or become further away from the housing 7A. Accordingly, it is possible to attach door lock 2A in correspondence with the width of door 1A.

(5) In addition, in the case of the embodiment where ring-shaped metal abrasion prevention members are respectively fitted over the end portions of cylindrical portions 56, 59 of inside bearing member 13A and outside bearing member 13b, metal abrasion between the ring-shaped metal abrasion prevention members and the inside and outside bearing, members can be prevented.

What is claimed is:

1. A door lock which comprises an inside lever handle (3A) and an outside lever handle (4A) attached to a lock body including a housing for assembly into an opening in a door, upon which the lock is to be secured, a latch including a latch bolt disposed on a latch shaft axis perpendicular to a handle shaft axis, said latch bolt is retracted by rotation of an inside or outside rotary shaft of the lock body, said outside rotary shaft (28A) including axially extending oppositely disposed slots (83), a cylinder lock 40A, said cylinder lock (40A) including oppositely disposed ribs that engage said axially extending oppositely disposed slots (83) and which engage slots in an inner wall of a tubular fitting portion (85) of said outside lever handle (4A), an inside return spring cassette, an outside return spring cassette, said outside return spring cassette (31A) including at least one elongated fitting tube (80) and at least one elongated threaded female screw portion (33A) extending therefrom in parallel with each other and said handle shaft axis, said inside return spring cassette including at least one fitting tube engagement rod (77) extending therefrom and at least one penetrating hole (73) therein, corresponding with said at least one elongated threaded female screw portion (33A), said fitting tube (80) and said fitting tube engagement rod for extending into said opening in said door with said fitting tube extending over said fitting tube engagement rod, and said penetrating hole (73) aligns with said threaded female screw portion and a bolt (34A) passes through said penetrating hole (73) and engages said threaded female screw portion in order to secure said inside return spring cassette to said outside return spring cassette and to prevent excessive movement of said latch bolt by operation of said outside lever handle.

2. A door lock as set forth in claim 1, in which said inside spring cassette includes more than one fitting tube engagement rod (77) and more than one penetrating hole (73), and said outside return spring cassette includes more than one fitting tube (80) and more than one elongated threaded female screw portion.

3. A door lock as set forth in claim 2, which includes synthetic resin metal abrasion prevention members having fitting holes respectively fitted to the rotary shafts and respectively fitted over end portions of cylindrical portions of an inside bearing member and an outside bearing member.

4. A door lock as set forth in claim 1, wherein an inside fixed plate constitutes a portion of the inside return spring cassette.

5. A door lock as set forth in claim 1, which includes an inside bearing member having a first adjustment screw thread and an outside bearing member having a second adjustment screw thread, and first and second adjustment rings having flanges in contact with an inside or an outside fixed plate are respectively screw-threaded to said bearing members, thus providing an adjustment to a position of at least one of the adjustment rings in correspondence with a thickness of the door.

6. A door lock as set forth in claim 1, wherein an inside bearing member having a first adjustment screw thread and an outside bearing member having a second adjustment screw thread are respectively provided at the lock body, and first and second adjustment rings having flanges in contact with the inside and outside return spring cassettes are respectively screw-connected to said bearing members, whereby adjustment of a position of at least one of said adjustment rings is made in correspondence with a thickness of the door upon which the lock is to be secured.

7. A door lock as set forth in claim 1, which includes synthetic resin metal abrasion prevention members having fitting holes respectively fitted relative to the rotary shafts and respectively fitted over an end portion of cylindrical portions of an inside bearing member and an outside bearing member.

* * * * *